US006891114B2

(12) United States Patent
Peterson

(10) Patent No.: US 6,891,114 B2
(45) Date of Patent: May 10, 2005

(54) SWITCH ASSEMBLY FOR A SUNROOF

(75) Inventor: David G. Peterson, Columbus, OH (US)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/428,757

(22) Filed: May 5, 2003

(65) Prior Publication Data

US 2004/0222075 A1 Nov. 11, 2004

(51) Int. Cl.[7] ..... H01H 19/00
(52) U.S. Cl. ..... 200/17 R; 200/329
(58) Field of Search ..... 200/17 R, 18, 200/547, 548, 5 R, 330, 331, 334, 16 R, 329, 4

(56) References Cited

U.S. PATENT DOCUMENTS 3,567,891 A 3/1971 Hinkelmann
4,590,338 A 5/1986 Suzuki
4,831,349 A 5/1989 Hirose et al.
4,844,532 A 7/1989 Ono et al.
4,876,493 A * 10/1989 Suzuki ..... 318/293
4,918,264 A 4/1990 Yamamoto et al.
5,610,375 A * 3/1997 Sinthomez ..... 200/50.01
5,721,405 A * 2/1998 Hamada ..... 200/16 R
5,902,972 A * 5/1999 Nestor et al. ..... 200/1 B
6,283,452 B1 9/2001 Kikuchi et al.

* cited by examiner

*Primary Examiner*—R. Lee
(74) *Attorney, Agent, or Firm*—Plumsea Law Group, LLC; Mark E. Duell

(57) ABSTRACT

A sunroof and a sunroof switch are disclosed. The switch includes provisions that assist in preventing the simultaneous operation of two different modes. A mechanical arrangement is used to prevent the knob from being depressed and slid at the same time. Also, in some cases, the mechanical arrangement can help to prevent the knob from being depressed once it has been moved or moved once it has been depressed.

27 Claims, 7 Drawing Sheets

SWITCH ASSEMBLY FOR A SUNROOF

BACKGROUND

1. Field of the Invention

This invention relates to a switch, and more particularly, to a switch for use with a sunroof.

2. Related Art

Sunroof switches associated with electronic or power sunroofs, generally permit an operator to open, close, and in some cases, tilt the sunroof. These three functions are generally carried out by a single switch that has four positions, including a rest position.

For example, if an operator moved the switch to one position, the forward position, the sunroof would close. If the operator moved the switch to a second, rearward position, the sunroof would open. Finally, if the switch were pressed in, towards the headliner or roof of the vehicle, the sunroof would tilt.

The switch must be operated carefully in order to avoid inadvertent motion of the switch. A problem can occur if the operator accidentally presses the switch while attempting to either open or close the sunroof. In these cases, the operator is attempting to open or close the sunroof, so the switch is moved to either the forward or rearward position. While the operator is holding the switch in either the forward or rearward position, the switch can be accidentally pressed in. In one example, the operator may experience a bump or impact due to a road condition while moving, that causes the operator to inadvertently press in the switch.

If the switch is accidentally pressed in while the switch is in either the forward or reward positions, problems can occur. In some cases, the sunroof ceases to function if multiple or inconsistent signals are received.

SUMMARY

A sunroof and a sunroof switch are disclosed. The switch includes provisions that assist in preventing the simultaneous operation of two different modes. A mechanical arrangement is used to prevent the knob from being depressed and slid at the same time.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
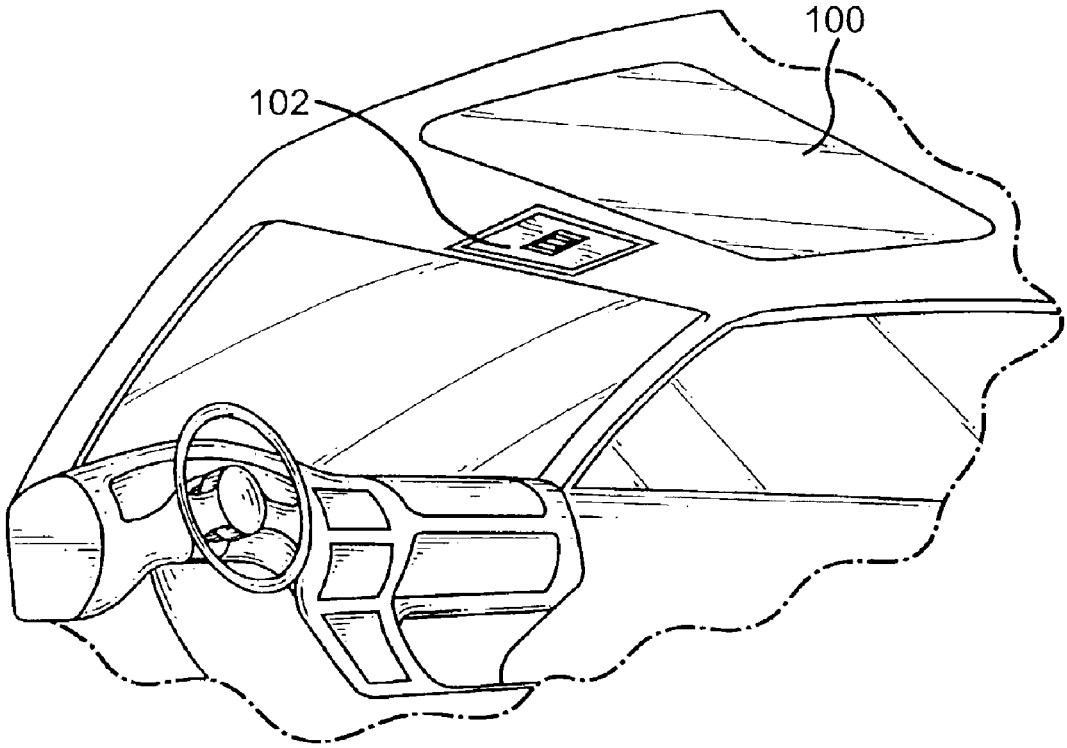
FIG. 1 is an isometric view of a preferred embodiment of a switch in association with a sunroof in accordance with the present invention.

FIG. 1 is an isometric view of an illustrative embodiment of a sunroof 100 and sunroof switch 102. Sunroof 100 preferably includes provisions that permit sunroof 100 to slide and tilt. In the embodiment shown in FIG. 1, switch 102 is used to control the operation of sunroof 100.

Figure 2:
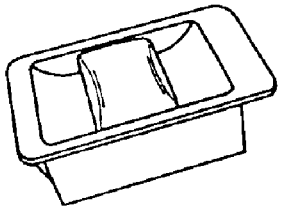
FIG. 2 is an isometric view of the switch of FIG. 1 in a rest position.
Figure 3:
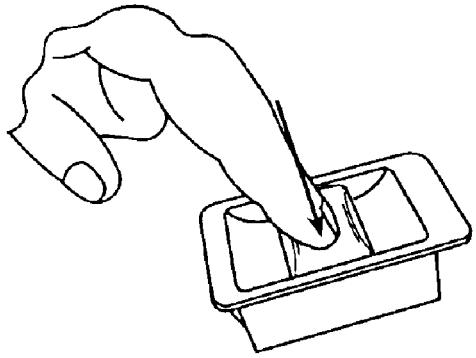
FIG. 3 is an isometric view of the switch of FIG. 1 in a depressed position.

Preferably, switch 102 includes four positions, as shown in FIGS. 2–5. Although a four position switch is preferred, principles of the present invention can be applied to switches that have more or less positions. FIG. 2 shows switch 102 in a rest position. In this position, switch 102 is not being operated or touched by a user, and knob 104 is generally centrally located within recess 106 formed in case 108. FIG. 3 shows switch 102 in a depressed position. In this position, knob 104 is moved towards case 108 and portions of knob 104 enter a hole 302 (see FIG. 8) in case 108 adapted to accommodate knob 104. Also in the depressed condition, knob 104 does not move laterally with respect to case 108 and remains generally centered in recess 106. In some embodiments, the depressed position of knob 104 is used to tilt the rear portion of sunroof 100 upwards.

Figure 4:
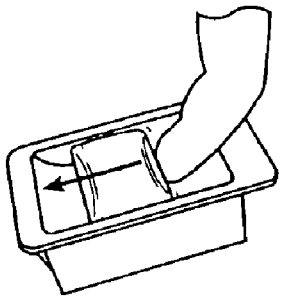
FIG. 4 is an isometric view of the switch of FIG. 1 in a forward position.

FIG. 4 shows a forward position of knob 104. In this position, knob 104 is not depressed, but moved laterally forward in recess 106 of case 108. As shown in FIG. 4, knob 104 is no longer centrally located within recess 106, but attains a position closer to a forward portion 110 of recess 106 than a rearward portion 112. In some embodiments, this position is used to close sunroof 100. In some embodiments, knob 104 can be moved past an intermediate detent or intermediate position to a fully forward position. The fully forward position provides an automatic sunroof close function where the sunroof will continue to close even after the operator has released knob 104 from the fully forward position.

Figure 5:
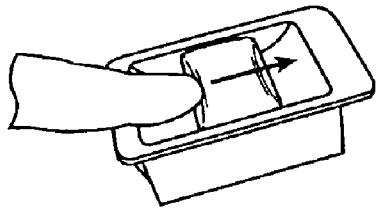
FIG. 5 is an isometric view of the switch of FIG. 1 in a rearward position.

FIG. 5 shows a rearward position of knob 104. In this position, knob 104 is not depressed, but moved laterally rearward in recess 106 of case 108. As shown in FIG. 5, knob 104 is no longer centrally located within recess 106, but attains a position closer to a rearward portion 112 of recess 106 than a forward portion 112. In some embodiments, this position is used to open sunroof 100. In some embodiments, knob 104 can be moved past an intermediate detent or intermediate position to a fully rearward position. The fully rearward position provides an automatic sunroof open function where the sunroof will continue to open even after the operator has released knob 104 from the fully rearward position.

Figure 6:
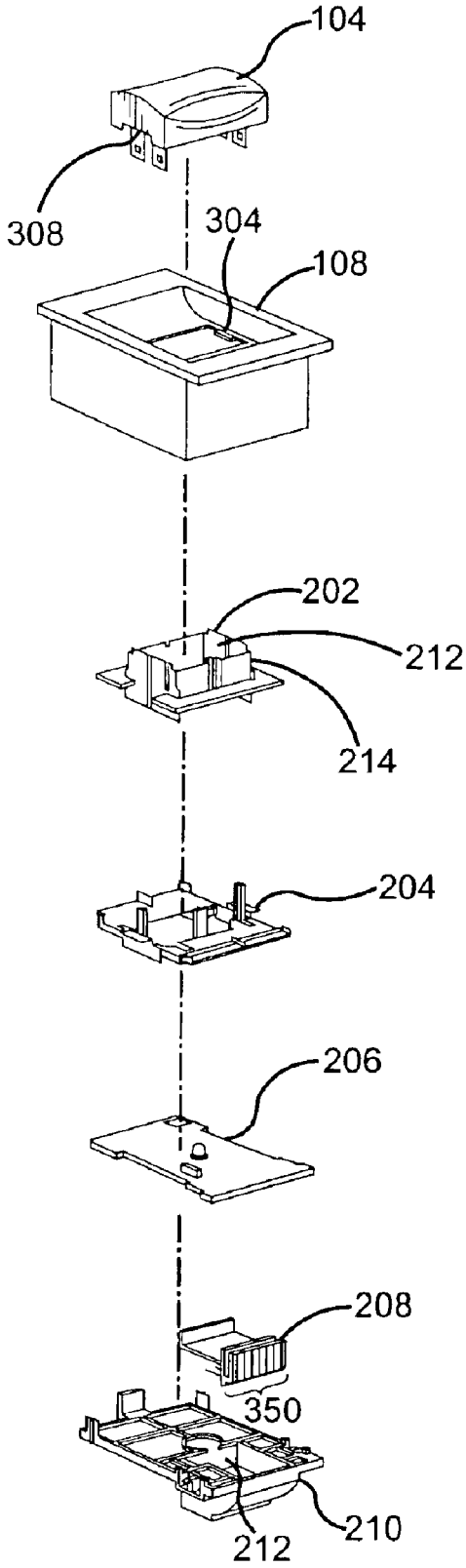
FIG. 6 is a schematic exploded isometric view of the switch of FIG. 1.
Figure 7:
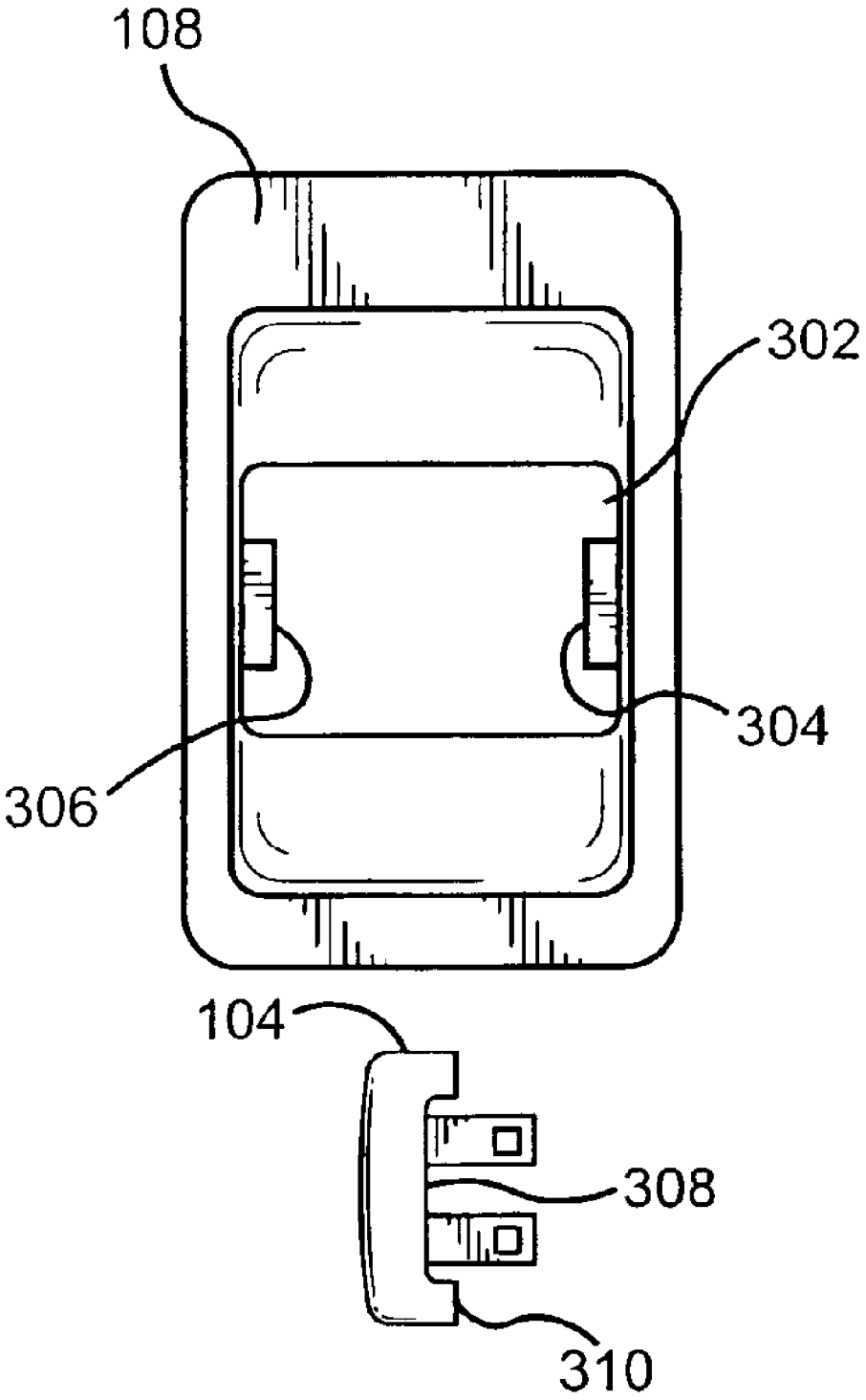
FIG. 7 is a disassembled view of the switch of FIG. 1.

FIG. 6 is a schematic, exploded isometric view of a preferred embodiment of switch 102. Switch 102 includes a case 108. Preferably, as shown in FIG. 1, case 108 is mounted to an interior roof portion of a vehicle, where switch 102 is accessible from the passenger cabin of the vehicle.

Case 108 includes a hole 302 (see FIG. 8) adapted to receive knob 104. First holder 202 is designed to retain knob 104 and includes a first holder hole 212 that is sized to receive knob 104. Preferably, first holder hole 212 includes walls 214 and is sized so that knob 104 fits snuggly inside the walls 214 of first holder hole 212. This arrangement helps to limit the motion between knob 104 and first holder 212. Preferably, knob 104 is limited to vertical motion within walls 214 of first holder 212.

First holder 202 is associated with second holder 204. Preferably, first holder 202 and second holder 204 include provisions that permit first holder 202 to be mounted onto second holder 204 and eliminate relative motion between first holder 202 and second holder 204 after assembly. Second holder 204 acts as a sled and is configured to move laterally with respect to Printed Circuit Board (PCB) 206. After assembly, knob 104, first holder 202 and second holder 204 move as a unit when knob 104 is moved laterally. Motion of knob 104 causes both first holder 202 and second holder 204 to move and also causes second holder 204 to move with respect to PCB 206.

Any known method or apparatus can be used to assist PCB 206 in receiving instructions and/or information from a user. Preferably, second holder 204 and knob 104 include one or more contacts that interact with corresponding contacts on PCB 206 to generate a signal that instructs other components of a sunroof system to perform a desired function. In some embodiments, an intermediate member, such as a strike pin (not shown) assists in facilitating interaction between knob 104 and PCB 206.

Guide 208 retains pins or conductors to facilitate mating with an electrical connector or wiring harness. Pins 250 that contact the bottom of PCB 206 are held by guide 208. Pins 250 are then preferably bent 90° as shown in FIG. 6. A connector hole 212 in base 210 permits an electrical connector or wiring harness to mate with the exposed ends of pins 250. The orientation of the exposed ends of pins 250 and connector hole 212 in base 210 provides a low profile arrangement for the electrical connector or wiring harness.

PCB 206 is attached to base 210 and base 210 is attached to case 108. Base 210 retains PCB 206 and acts as a bottom cover of switch 102. These three items, case 108, PCB 206 and base 210, form the basic stationary members of switch 102.

As discussed above, problems can arise when more than one instruction or signal is sent to a sunroof system at the same time. Switch 102 includes provisions that prevent this from occurring.

In one embodiment, shown in FIGS. 7–10, switch 102 includes mechanical provisions that prevent the simultaneous actuation of knob 104 in more than one direction. Case 108 includes at least one tab 304 projecting into hole 302. In the exemplary embodiment shown in FIG. 7, case 108 includes two tabs 304 and 306 that project into hole 302 from opposite sides. A notch 308 is preferably formed on a side of knob 104. If two tabs are used, a second notch 310 is formed on a side corresponding to the other tab in case 108. In the embodiment shown in FIG. 7, second notch 310 corresponds to second tab 306.

Figure 8:
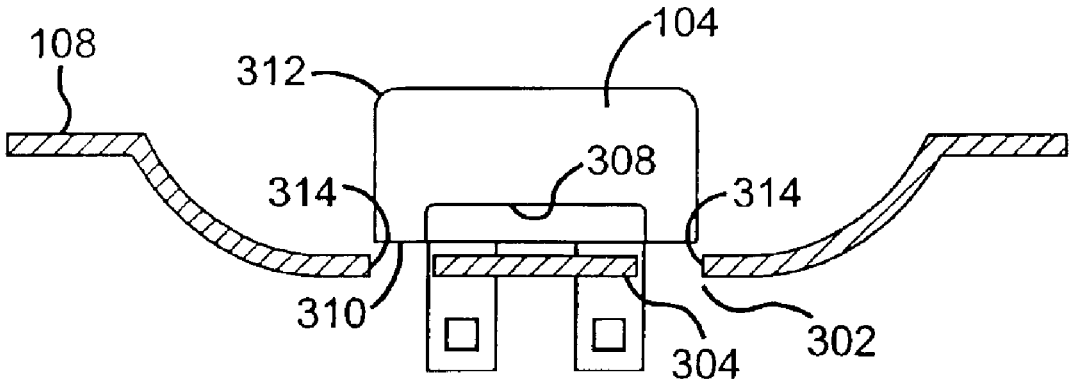
FIG. 8 is a cross sectional view of the switch of FIG. 1.
Figure 9:
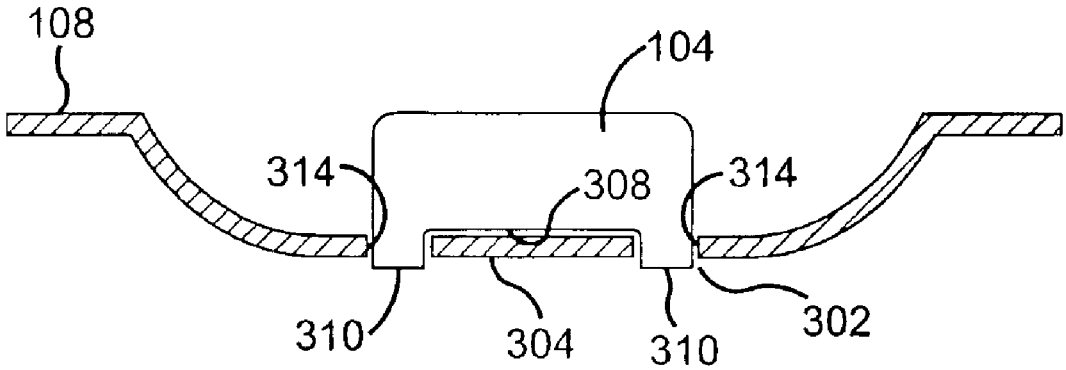
FIG. 9 is a cross sectional view of the switch of FIG. 1 in a depressed position.
Figure 10:
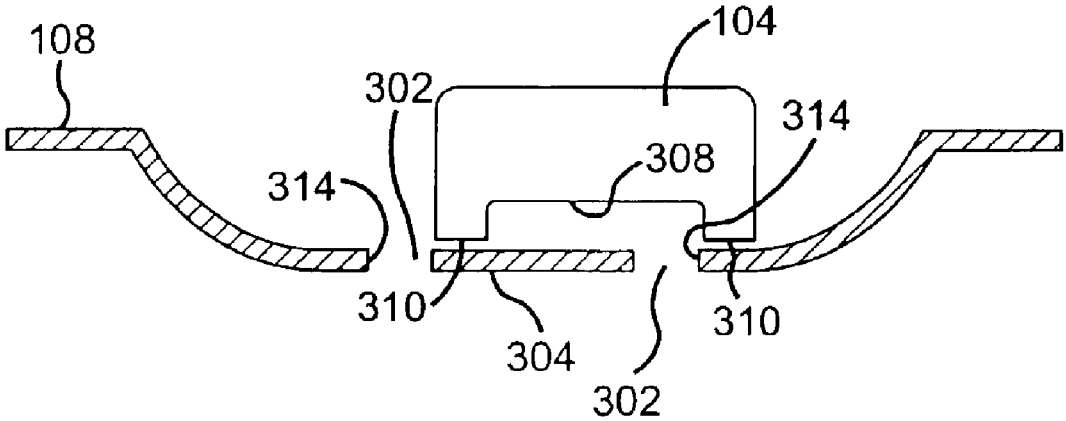
FIG. 10 is a cross sectional view of the switch of FIG. 1 in a laterally displaced position.
Figure 11:
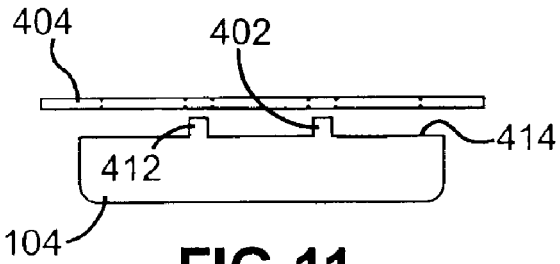
FIG. 11 is a schematic side view of an alternative embodiment of a switch in a rest position.
Figure 12:
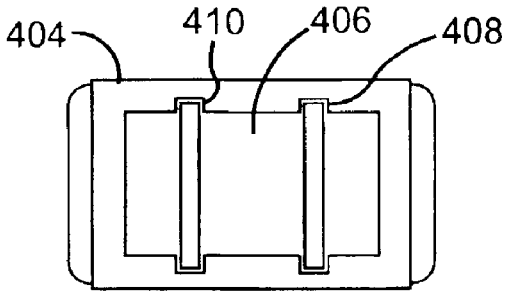
FIG. 12 is a schematic bottom view of the switch of FIG. 11 in a rest position.

FIGS. 8–10 show the interaction between notch 308 and tab 304. If knob 104 is depressed, knob 104 can travel towards case 108 because notch 308 accommodates tab 304 allows knob 104 to assume a depressed position. The depressed position of knob 104 is shown in FIG. 9. If knob 104 is moved in either lateral direction, tab 304 does not interfere with the lateral motion of knob 104 because tab 304 is preferably disposed below the lower edge 310 of knob 104. A laterally displaced position of knob 104 is shown in FIG. 10. Because of this arrangement, lower edge 310 of knob 104 can pass over tab 304 without contacting tab 304.

Tab 304 is particularly useful in preventing the simultaneous actuation of more than one function. In some cases, knob 104 may be touched or actuated in away where knob 104 could possibly be moved laterally as well as depressed. This can occur when knob 104 is touched at a corner 312. This can also occur if the operator is suddenly bumped or jolted by a road irregularity while driving.

In those cases, where an attempt is made to move knob 104 in a way where knob 104 is depressed as well as moved laterally, tab 304 prevents knob 104 from achieving simultaneous motion in a lateral direction and a downward or depressed direction.

Regardless of how knob 104 is touched or actuated, lower edge 310 of knob 104 will either enter hole 302 or slide laterally and rest on the upper surface of tab 304. In those cases where knob 104 enters hole 302, tab 304 and/or sides 314 of hole 310 prevents knob 104 from moving laterally. In those cases where knob 104 is moved laterally before knob 104 is depressed, lower edge 310 of knob 104 will slide over tab 304 and prevent knob 104 from being depressed. In this way, the mechanical provisions provided on knob 104 and on case 108 prevent the simultaneous actuation of knob 104 in two different directions.

Also, once knob 104 has assumed a depressed position, notch 308 interacts with tab 304 to prevent knob 104 from moving laterally. In some embodiments, sides 314 also cooperate with the edges of knob 104 to prevent lateral motion after knob 104 has been depressed.

Similarly, once knob 104 has assumed a laterally displaced position, tab 304 interacts with the bottom 310 of knob 104 to prevent knob 104 from being depressed. In some embodiments, the lower surface of case 108 also interacts with the bottom 310 of knob 104 to prevent knob 104 from being depressed when knob 104 has assumed a laterally displaced position.

FIGS. 11–17 show another embodiment of the present invention. Referring to FIGS. 11–17, knob 104 includes at least one projection 402 that extends away from a lower surface 414 of knob 104. In some embodiments, knob 104 includes a second projection 412.

Similar to the embodiment shown in FIGS. 7–10, knob 104 cooperates with a lower portion of case 108. For clarity, only the lower portion 404 of case 108 is shown in FIGS. 11–17. It should be kept in mind, however, that this embodiment, as well as the embodiment shown in FIGS. 7–10, can also be used with a case similar to case 108 shown in FIGS. 7–10 or be used with a different type of case.

Preferably, a hole 406 is provided on lower portion 404 of the case to allow knob 104 to associate with other switch components. Hole 406 preferably includes at least one slot 408 that is configured to receive projection 402 of knob 104. If there are two projections disposed on lower surface of knob 414, then preferably, an additional slot 410 is preferably provided. Generally, lower surface 404 of the case includes a corresponding number and shape of slots or apertures as there are projections or irregularities provided on knob 104 so that knob 104 can mate, interface or enter lower surface 414 in only one lateral position. In other lateral positions, the shape and/or number of the slots and/or apertures prevent engagement of knob 104 with lower surface 404.

Figure 13:
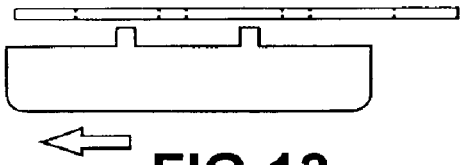
FIG. 13 is a schematic side view of the switch of FIG. 11 in a laterally displaced position.
Figure 14:
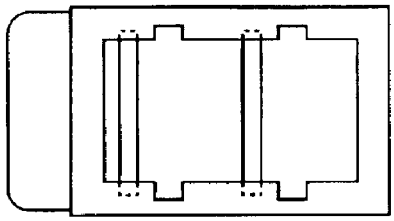
FIG. 14 is a schematic bottom view of the switch of FIG. 11 in a laterally displaced position.
Figure 15:
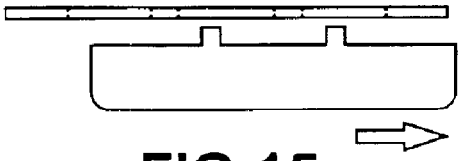
FIG. 15 is a schematic side view of the switch of FIG. 11 in a laterally displaced position.
Figure 16:
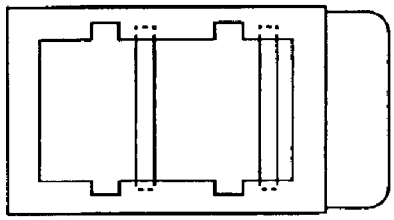
FIG. 16 is a schematic bottom view of the switch of FIG. 11 in a laterally displaced position.

FIGS. 13 and 14 show knob 104 in a first laterally displaced position. In this position, the projections 402 and 412 or knob 104 are not aligned with slots 408 and 410, respectively. In this first laterally displaced position, knob 104 is not able to assume a depressed position. FIGS. 15 and 16 show knob 104 in a second laterally displaced position. Similar to the position shown in FIGS. 13 and 14, knob 104, due to the misalignment of projections and slots, is unable to assume a depressed position.

Figure 17:
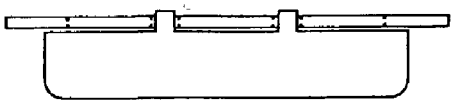
FIG. 17 is a schematic side view of the switch of FIG. 11 in a depressed position.

FIG. 17 shows a depressed position. Notice that projections 402 and 412 are aligned with slots 408 and 410. This alignment permits knob 104 to assume a depressed position. In the embodiment shown in FIG. 17, this alignment allows the projections 402 and 412 of knob 104 to enter slots 408 and 410, respectively, thus permitting knob 104 to assume a depressed position.

While various embodiments of the invention have been described, it will be apparent to those of ordinary skill in the art that may more embodiments and implementations are possible that are within the scope of the invention. Accordingly, the invention is not to be restricted except in light of the attached claims and their equivalents.

What is claimed is:

1. A switch comprising:

a case and a knob, where the knob is configured to move with respect to the case;

a mechanical provision associated with the case that permits lateral motion in a forward direction and a rearward direction while preventing the knob from being despressed;

the case including a hole configured to receive the knob, the hole having a forward side facing the forward direction, a rearward side facing the rearward direction and a lateral side;

wherein the mechanical provision that permits lateral motion while preventing the knob from being despressed is a tab protecting into the hole from the lateral side.

2. The switch according to claim 1, where the mechanical provision permits the knob to be depressed but prevents the knob from moving laterally.

3. The switch according to claim 1, wherein the hole formed in the case extends through the case.

4. The switch according to claim 1, where the knob includes a recess corresponding to the tab.

5. The switch according to claim 1, further comprising a second tab projecting into the hole formed in the case.

6. The switch according to claim 5, where the knob includes a second recess corresponding to the second tab.

7. A switch comprising:

a case configured to associate with the interior of a vehicle;

a first holder associated with the case, the first holder having a hole configured to receive a knob, where the first holder can move relative to the case;

the knob being disposed in the hole and being capable of assuming a depressed position;

where a mechanical provision on the case prevents the simultaneous motion of the first holder and depression of the knob; and wherein the mechanical provision on the case is disposed below a lower edge of the knob when the knob is in a rest position prior to being depressed.

8. The switch according to claim 7, wherein the hole in the first hole includes a walled portion.

9. The switch according to claim 7, wherein the first holder is associated with a second holder, the second holder configured to move laterally.

10. The switch according to claim 7, further comprising a printed circuit board configured to cooperate with the second holder.

11. The switch according to claim 7, wherein the mechanical provision includes a tab associated with the case.

12. The switch according to claim 7, wherein the mechanical provision includes a second tab disposed opposite a first tab associated with the case.

13. The switch according to claim 7, wherein a mechanical provision on the knob includes a notch associated with the knob.

14. The switch according to claim 7, wherein the mechanical provision includes a slot disposed on a lower surface of the case.

15. A switch comprising:

a means for providing at least three positions to a knob, wherein the three positions includes a rest position, a laterally displaced position and a depressed position;

means for preventing the knob from being simultaneously displaced laterally and depressed; and wherein the knob includes a first laterally displaced side and a second side different than the first laterally displaced side; and wherein the means for preventing the knob from being simultaneously displaced laterally and depressed includes a notch formed on the second side of the knob.

16. The switch according to claim 15, including a means for allowing the knob to assume a second laterally displaced position.

17. The switch according to claim 15, including a means for allowing the knob to assume a second laterally displaced position opposite the laterally displaced position; the knob including a third side facing the second laterally displaced position; the third side being different than the second side.

18. The switch according to claim 15, including a means for preventing the knob from being depressed after the knob has assumed a laterally displaced position.

19. The switch according to claim 15, including a means for preventing the knob from being moved laterally after the knob has assumed a depressed position.

20. The switch according to claim 15, wherein the means for preventing the knob from being simultaneously displaced laterally and depressed includes a tab associated with the case.

21. A switch comprising:

a case including a hole extending through the case, and at least one slot extending through the case;

a knob cooperating with the case and including at least one projection extending from a lower surface of the knob, the knob having a first position, and a second laterally displaced position; and wherein the projection of the knob aligns with the slot when the knob is in the first position.

22. The switch according to claim 21, wherein the knob includes a second projection configured to align with a second slot disposed in the case.

23. The switch according to claim 22, wherein the second projection aligns with a second slot disposed in the case when the knob is in the first position.

24. The switch according to claim 21, wherein the knob includes a plurality of projections configured to align with a respective plurality of slots disposed in the case.

25. The switch according to claim 21, wherein the projection prevents the knob from being depressed when the knob is in the second laterally displaced position.

26. The switch according to claim 21, wherein the knob includes a third laterally displaced position opposite the second laterally displaced position.

27. The switch according to claim 26, wherein the projection prevents the knob from being depressed when the knob is in the third laterally displaced position.

* * * * *